US006491549B1

(12) United States Patent
Billman

(10) Patent No.: US 6,491,549 B1
(45) Date of Patent: Dec. 10, 2002

(54) BACKPLANE CONNECTOR WITH JUXTAPOSED TERMINAL MODULES THEREOF

(75) Inventor: Timothy Brian Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/932,034

(22) Filed: Aug. 17, 2001

(51) Int. Cl.[7] ..... H01R 24/00
(52) U.S. Cl. ..... 439/637; 439/635
(58) Field of Search ..... 439/637, 717, 439/721, 722, 635, 365, 725, 634

(56) References Cited

U.S. PATENT DOCUMENTS 2,981,922 A * 4/1961 Valkenburg et al. ..... 439/717
3,196,378 A * 7/1965 Beckwith ..... 439/634
3,518,610 A * 6/1970 Goodman et al. ..... 439/634
5,584,728 A * 12/1996 Cheng ..... 439/637
5,785,534 A * 7/1998 Longueville et al. ..... 439/608
6,315,595 B1 * 11/2001 LaPorte et al. ..... 439/403

* cited by examiner

*Primary Examiner*—Khiem Nguyen
*Assistant Examiner*—Hae Moon Hyeon
(74) *Attorney, Agent, or Firm*—Wei Te Chung

(57) ABSTRACT

A backplane connector (2) has a housing (4), an inserted body (6) and a plurality of contacts (10) inside the housing. The inserted body can be swiveled toward the contacts and away from each other. In a mounting position, in which the inserted body and the plurality of signal contacts are swiveled away from each other, insertion of a PCB into the housing is permitted. In a connecting position, the inserted body and the plurality of signal contacts are swiveled toward each other. The inserted body is formed of a plurality of terminal modules which are arranged in lengthwise series alongside one another.

15 Claims, 6 Drawing Sheets

BACKPLANE CONNECTOR WITH JUXTAPOSED TERMINAL MODULES THEREOF

BACKGROUND OF THE INVENTION

1. Field of the Invention

The present invention relates to circuit board connectors, and particularly to a so-called backplane connector, and to the copending U.S. Pat. Nos. 09/893,810 filed Jun. 27, 2001 and 09/904,353 filed Jul. 11, 2001, and an application filed on Aug. 17, 2001 with an unknown serial number titled "CONNECTOR HAVING MOVEABLE INSERT" having the same inventor and the same assignee with the instant application.

2. Description of Related Art

U.S. Pat No. 5,785,534 discloses an electrical connector having contacting devices which establish electrical contact wit a module board. In this design, the contacting devices has a housing and two connector halves which are accommodated in the housing and swivelable toward and away from each other. In a mounting position, in which the two connector halves are swiveled away from each other, the connector halves allow the insertion of one PCB Printed Circuit Board) to be brought into contact with them. In a connecting position, in which the two connector halves are swiveled towards each other they establish a contact with the inserted PCB. In a word, the connector serves the purpose of electrically and mechanically interconnecting the inserted PCB to a PCB the connector is mounted.

The connector generally includes a plurality of contacts located in each half. In different applications, PCBs of different lengths are needed so that the number of the contacts must be changed as required. For this reason, the connectors are to be offered in different lengths, the various lengths preferably corresponding to an integral multiple of a basic length which can be provided in advance.

However, conventional backplane connector is integrally manufactured in a single process. In other words, in order to fit the length of the connector being variable, it is needed to provide a plurality of molds respect to different lengths if possible. Thus, it involves relatively high expenditure.

SUMMARY OF THE INVENTION

Accordingly, the object of the present invention is to provide a backplane connector, which allows the connector to be both manufactured in a simple manner and processed in a simple manner even if the backplane connector is to be variable in its dimensions.

In order to achieve the object set forth, a backplane connector comprises an insulative housing, a plurality of signal contacts received in one side of the housing, and an inserted body accommodated in the housing. The inserted body can be selectively swivelable toward to the signal contacts into a connecting position and away from each other into a mounting position. The inserted body has a plurality of terminal modules longitudinally disposed in series alongside one another without gaps therebetween. The terminal modules of the inserted body includes a pair of identical lateral terminal module and a plurality of inner terminal modules between the pair of lateral terminal modules.

Other objects, advantages and novel features of the invention will become more apparent from the following detailed description when taken in conjunction with the accompanying drawings.

DETAILED DESCRIPTION OF THE INVENTION

Figure 1:
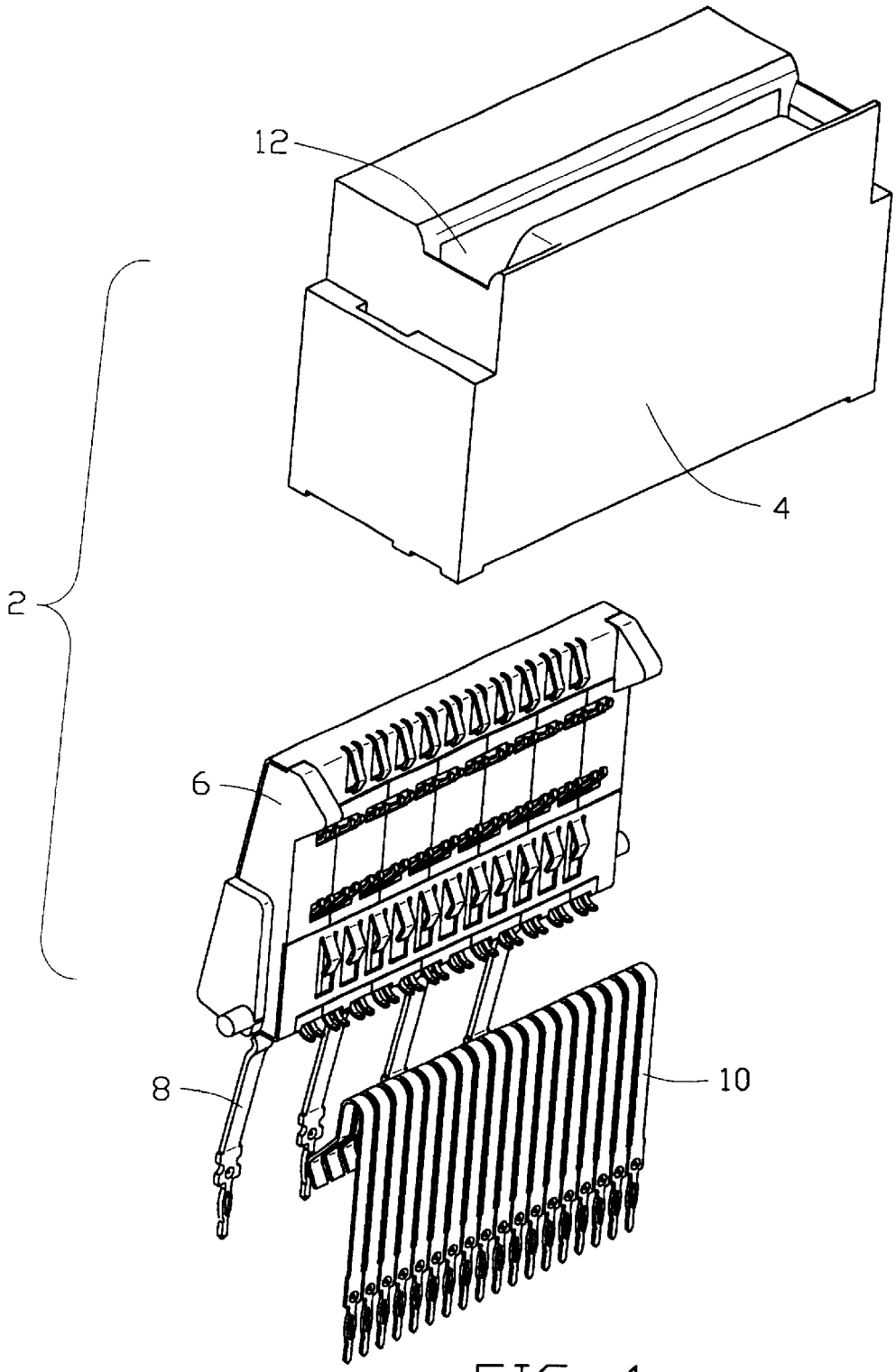
FIG. 1 is an exploded perspective view of a backplane connector of the present invention.
Figure 2:
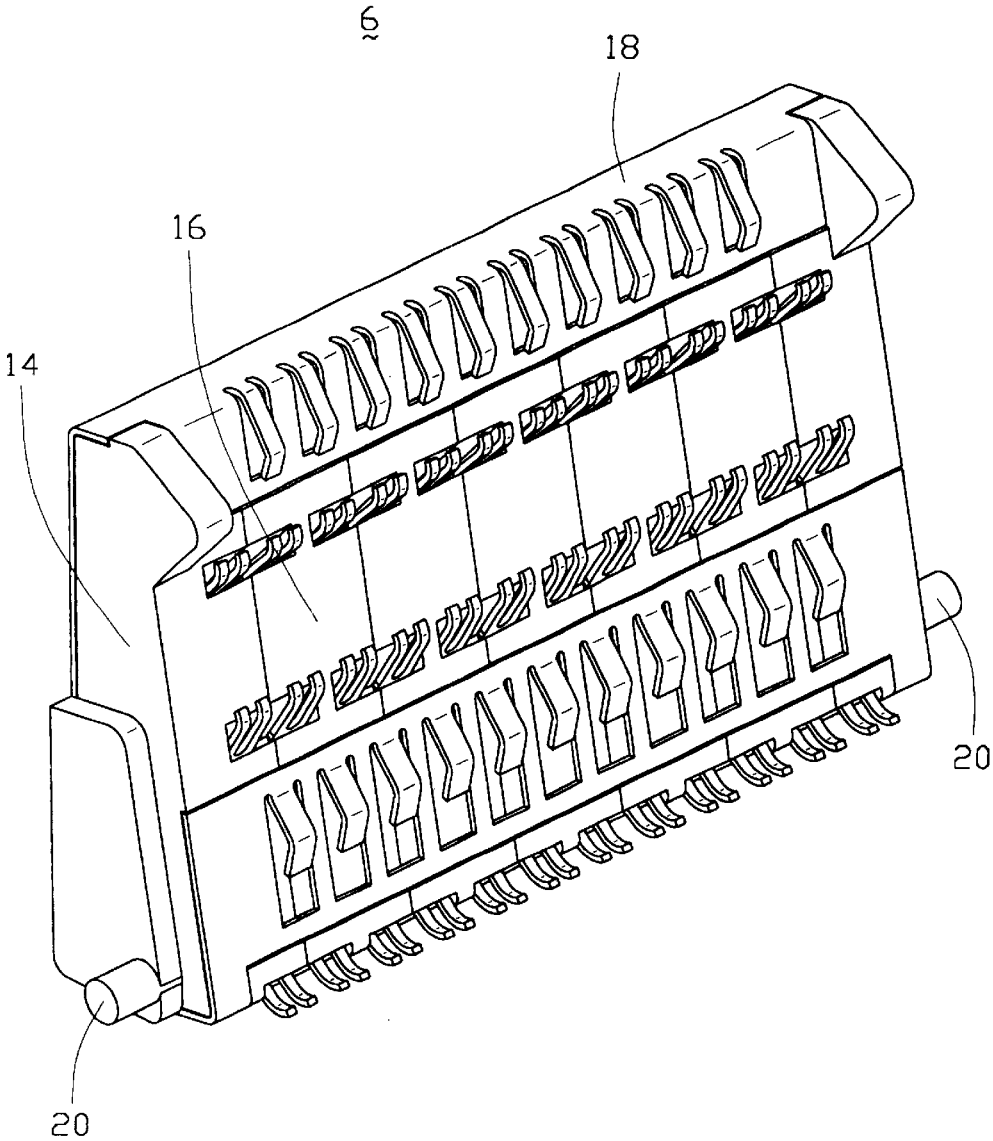
FIG. 2 is a perspective view of an inserted body of the backplane connector.
Figure 3:
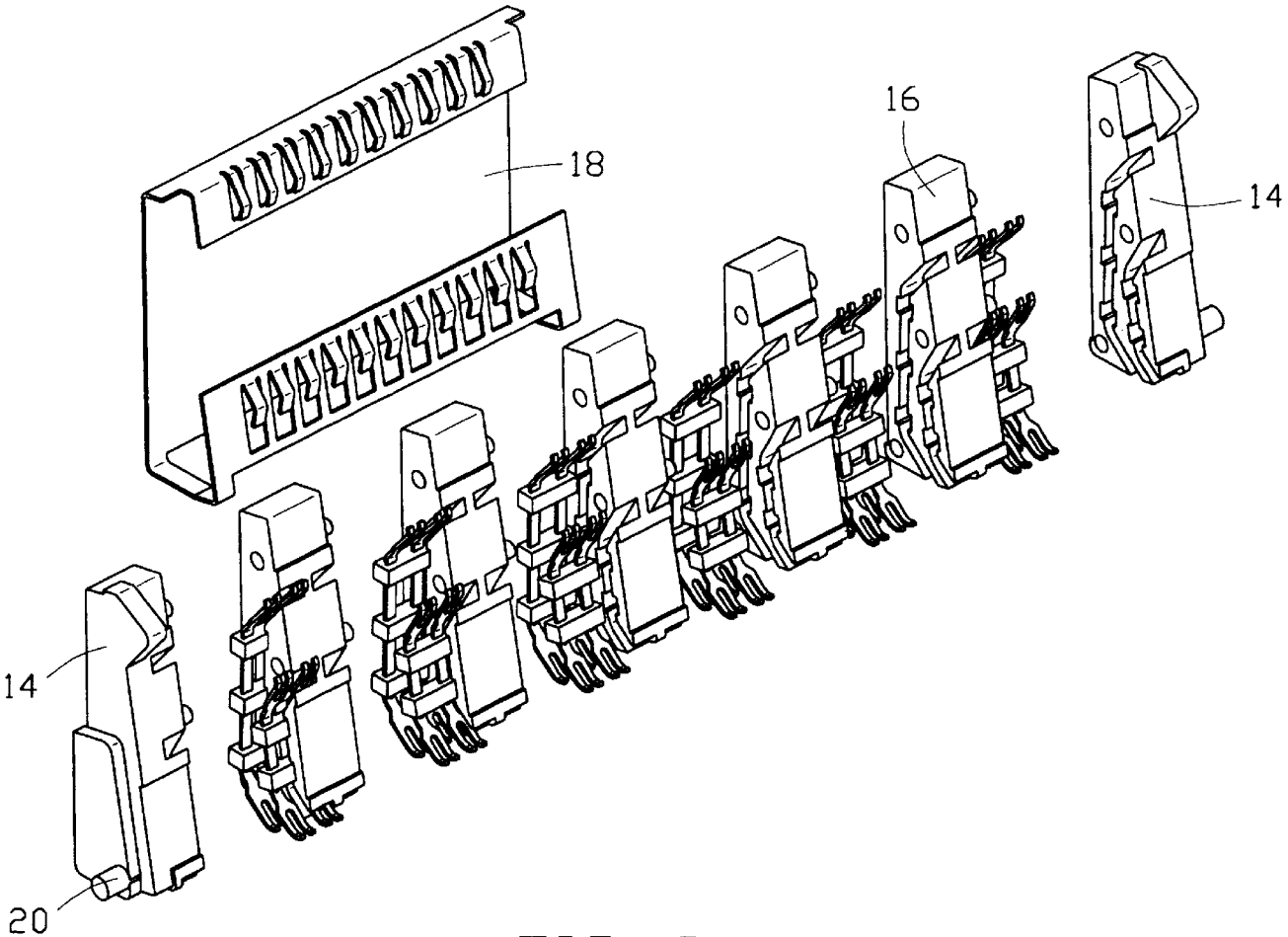
FIG. 3 is an exploded view of the inserted body shown in FIG. 2.
Figure 4:
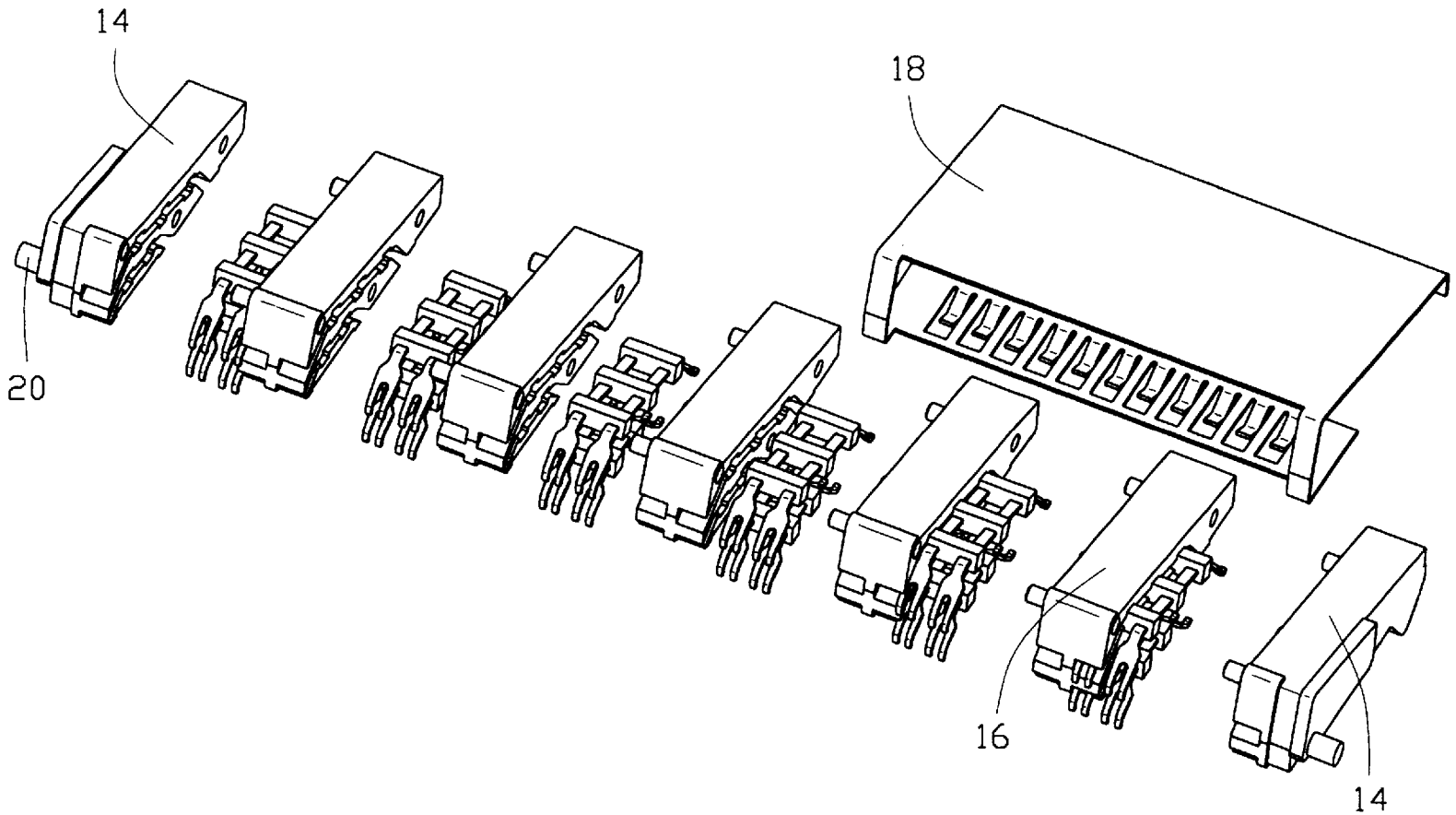
FIG. 4 is another exploded view of the inserted body.

Reference will now be made to the drawing figures to describe the present invention in detail.

Referring to FIGS. 1–4, a backplane connector 2 of the present invention comprises an insulative housing 4, an inserted body 6 accommodated in the insulative housing 4, and a plurality of grounding contacts 8 and signal contacts 10 received in the insulative housing 4. The housing 4 defines an opening 12 on the upper side thereof. The inserted body 6 is swiveled or swung synchronously toward to the signal contacts 10 and away from each other, by this design, they allow an insertion of one PCB (not shown) to be brought into contact with each other in a mounting position and establish a contact with the inserted PCB in a connecting position.

The inserted body 6 comprises a multiplicity of terminal modules 14 and 16 arranged in series alongside one another, and a shield 18 enclosing the terminal module 14 and 16. Bach lateral terminal module 14 includes a lug 20. The inserted body 6 can be inserted into the housing 10 from the underside of the housing 4 and swung therein by the lug 20.

Figure 5:
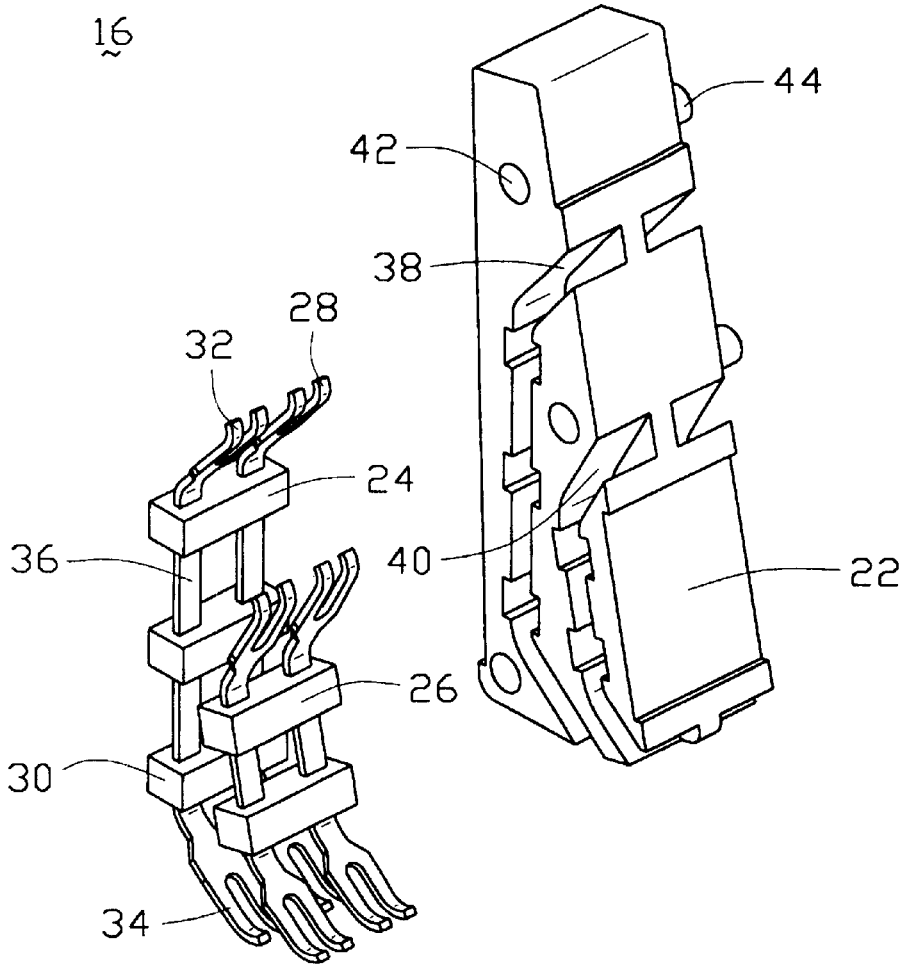
FIG. 5 is an exploded view of a terminal module in the inserted body.
Figure 6:
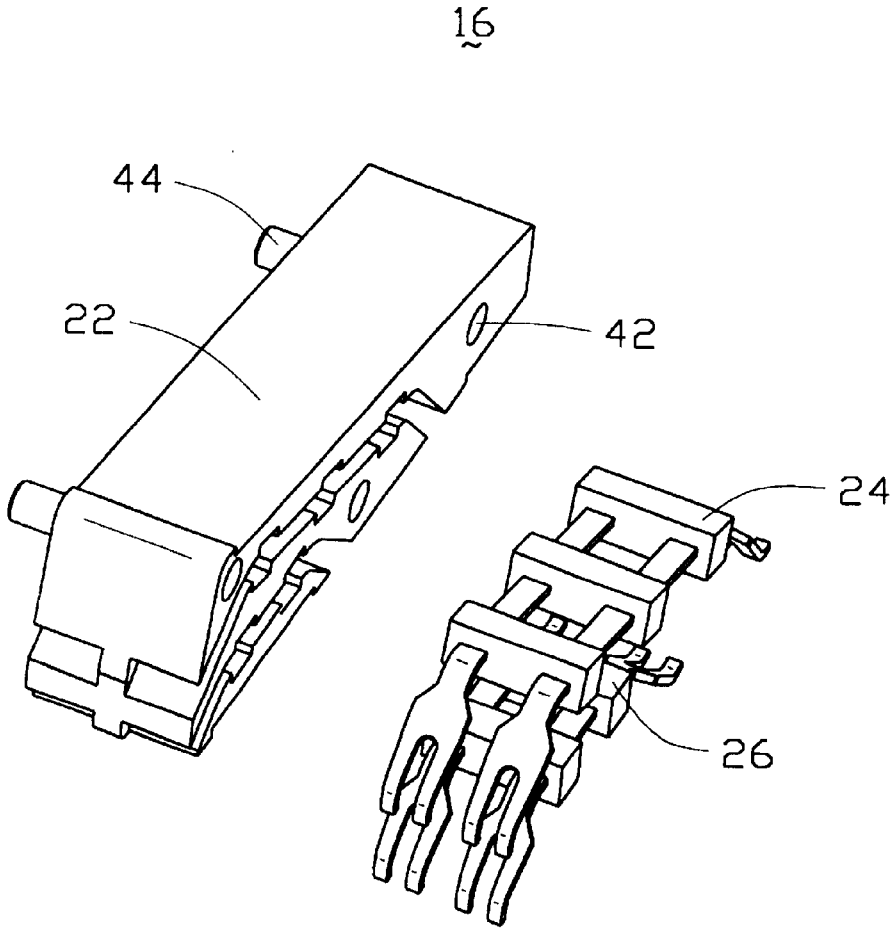
FIG. 6 is another exploded view of the terminal module.

The construction of each inner terminal module 16 will now be described with reference to FIGS. 5 and 6. All the inner terminal modules 16 have exactly the same construction in the example under consideration.

Each terminal module 16 defines a unit length and has an insulative part 22, a first terminal unit 24 and a second terminal unit 26. The first and second terminal units 24 and 26 have a pair of terminals 28 joined together by insulating elements 30. The terminal 28 includes an engaging portion 32, a sliding portion 34, and a base portion 36 between the engaging portion 32 and the sliding portion 34, wherein the insulating elements 30 are attached to the base portion 36.

The insulative part 22 defines an upper recess 38 and a lower recess 40 on either side thereof. The upper recesses 38 and lower recesses 40 of every two adjacent insulative parts 22 is in communication with each other thereby defining two channels to receive the first and second terminal units 24 and 26. The insulative part 22 defines several holes 42 and projections 44 on both sides thereof, wherein a projection 44 of one insulative part 22 can be inserted into corresponding hole 42 of another adjacent insulative part 22. Thus, the inner terminal modules 16 can be assembled together in scheduled number, which is corresponding to the actual length of the backplane connector.

Similar to the inner terminal module described above, one of the lateral terminal modules 14 has several holes, and the other has several projections with respect to the holes.

In the completely assembled state of the backplane connector, all the terminal modules 14 and 16 are longitudinally disposed in series alongside one another without gaps therebetween and permit the inserted body 6 to be received in the housing 4. An outer PCB can then be inserted through the channel between the inserted body 6 and the signal contacts 10, thereby mechanically and electrically engaging with the terminals 28 and signal contacts 10.

In the mounting position, in which the inserted body 6 and the plurality of signal contacts 10 are swiveled away from each other, they allow the insertion of a PCB. In the connecting position, the inserted body 6 and the plurality of signal contacts 10 are swiveled toward each other. The inserted body 6 is formed of a plurality of terminal modules 14 and 16 which are arranged in lengthwise series alongside one another thereby engaging with the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A backplane connector comprising:

an insulative housing;

a plurality of signal contacts received in one side of the housing; and an inserted body accommodated in the housing and being selectively swivelable toward the signal contacts into a connecting position and away from each other into a mounting position, the inserted body having a plurality of terminal modules longitudinally disposed in series alongside one another without gaps therebetween.

2. The backplane connector as described in claim 1, wherein the terminal modules of the inserted body include a pair of lateral terminal modules and a plurality of inner terminal modules between the pair of lateral terminal modules.

3. The backplane connector as described in claim 2, wherein a length of each of the terminal modules defines a unit length increment within which a length of the backplane connector is variable.

4. The backplane connector as described in claim 3, wherein each inner terminal module includes an insulative part having two sets of recesses on two opposite sides, a terminal unit being received in said sets of recesses facing each other on two adjacent terminal modules.

5. The backplane connector as described in claim 2, wherein each of the inner terminal modules defines several holes and projections on both sides thereof, and each projection of one terminal module can be inserted into a corresponding hole of an adjacent terminal module.

6. The backplane connector as described in claim 5, wherein one of the lateral terminal modules has several holes to engage with a corresponding projection of another terminal module, and the other lateral terminal module has several projections to fit in a corresponding hole of another terminal module.

7. An electrical connector comprising:

an insulative housing;

an inserted body retained in said housing, said inserted body including:

a plurality of terminal modules juxtaposed one another, each of said terminal modules defining two spaced recesses on both sides thereof, respectively; and a plurality of terminal units each including a plurality of terminals joined together by insulating means; wherein each of said terminal units is positioned between two adjacent terminal modules with one portion thereof embedded within a first corresponding recess of one of said two adjacent terminal modules and with the remaining portion thereof embedded within a second corresponding recess of the other of said two adjacent terminal modules, said first corresponding recess being opposite to said second corresponding recess.

8. The connector as described in claim 7, wherein said terminals extend lengthwise along the corresponding recess and out of the corresponding terminal module to be exposed in an interior of said housing beside said insert body.

9. The connector as described in claim 7, wherein the terminal unit disposed between two adjacent terminal modules, is fully received within the corresponding recesses of said two adjacent terminal modules without resulting in a gap therebetween.

10. The connector as described in claim 7, wherein said terminal modules are enclosed and bonded by an outer metal shell.

11. The connector as described in claim 10, wherein said outer shell includes a plurality of tangs extending into an interior of the housing beside said insert body.

12. An electrical connector comprising:

an insulative housing;

an inserted body retained in said housing, said inserted body including:

a plurality of terminal modules juxtaposed one another, each of said terminal modules defining spaced first and second recesses on at lest one side thereof, both the first recess and the second recess lengthwise extending through the corresponding terminal module while the first recess extending longer and higher than the second recess;

a plurality of first type terminal units each including a plurality of first type terminals joined together by insulating means;

a plurality of second type terminal units each including a plurality of second type terminals joined together by insulating means;

each of said first type terminal units being essentially larger than each of said second type terminal units;

each of said first type terminal units inserted into the first recess of the corresponding terminal module in a longitudinal direction of the housing, each of said second type terminal units inserted in to the second recess of the same corresponding terminal module in the same longitudinal direction, each of the first type terminals defining a first free end, each of the second type terminals defining a second free end, said first free end exposed in an interior of the housing beside said insert body, is positioned higher than the second free end which is also exposed in the same interior.

13. The connector as described in claim 12, wherein said terminal modules are enclosed and bonded by an outer metal shell.

14. The connector as described in claim 13, wherein said outer shell includes a plurality of tangs extending into the interior of the housing.

15. An electrical connector comprising:

an insulative housing:

an inserted body retained in said housing, said inserted body including:

a plurality of terminal modules juxtaposed one another, each of said terminal modules defining spaced recesses therein; and a plurality of terminal units each including a plurality of terminals joined together by insulating means; wherein each of said terminal units is positioned in the corresponding recesses of the adjacent two corresponding terminal modules, and said terminal modules are enclosed and bonded by an metal shell without any gap left between every adjacent two terminal modules.

* * * * *